US008757379B2

(12) United States Patent
Yang

(10) Patent No.: US 8,757,379 B2
(45) Date of Patent: Jun. 24, 2014

(54) SCREW DRIVER TOOL BOX

(75) Inventor: Chih Ming Yang, Tainan (TW)

(73) Assignee: Marvellous Technology Co., Ltd, Tainan (TW)

( * ) Notice: Subject to any disclaimer, the term of this patent is extended or adjusted under 35 U.S.C. 154(b) by 10 days.

(21) Appl. No.: 13/206,498

(22) Filed: Aug. 9, 2011

(65) Prior Publication Data

US 2012/0228172 A1 Sep. 13, 2012

(30) Foreign Application Priority Data

Mar. 7, 2011 (TW) ..... 100203974 U

(51) Int. Cl.
*B65D 85/28* (2006.01)

(52) U.S. Cl.
USPC ..... 206/375; 206/379

(58) Field of Classification Search
USPC ..... 206/373, 374, 375, 372, 376, 379, 378
See application file for complete search history.

(56) References Cited

U.S. PATENT DOCUMENTS 5,512,165 A * 4/1996 Liu ..... 206/234
6,405,865 B1 * 6/2002 Lin ..... 206/379
7,624,863 B2 * 12/2009 Meng ..... 206/349
7,677,391 B2 * 3/2010 Pistor et al. ..... 206/379
7,770,727 B2 * 8/2010 Meng ..... 206/373
8,083,060 B1 * 12/2011 Liu ..... 206/379
2005/0161356 A1 * 7/2005 Chen ..... 206/373
2005/0247587 A1 * 11/2005 Holland-Letz ..... 206/373
2006/0016706 A1 * 1/2006 Chen ..... 206/379
2006/0118446 A1 * 6/2006 Liu ..... 206/373
2011/0088519 A1 * 4/2011 Hu ..... 81/63.1

* cited by examiner

*Primary Examiner* — Jacob K Ackun
*Assistant Examiner* — Jenine Pagan

(57) ABSTRACT

A screw driver tool box includes an accommodating box, a plurality of screw heads, and a driver rod. Both sides of the accommodating box are provided with a turnable accommodating base respectively. The accommodating base is provided with a plurality of accommodating troughs for allowing the driver heads to be inserted therein. One end of the driver rod is formed with a handle portion, and the other end thereof is formed into a connecting end. The connecting end is provided with an insertion trough for allowing the driver heads to be inserted therein. The present invention is characterized in that: the accommodating box comprises a sleeve. One end of the sleeve is formed into an opening for insertion. The walls around the opening are provided with a plurality of grooves and a plurality of clamping claws. The clamping claws protrude from the opening. A through-hole is provided on a wall of the accommodating box to correspond to the opening. By the above-mentioned structure, a screw driver tool box which is easy to carry and convenient in use is obtained.

1 Claim, 3 Drawing Sheets

SCREW DRIVER TOOL BOX

BACKGROUND OF THE INVENTION

1. Field of the Invention

The present invention relates to a screw driver tool box, and in particular to a screw driver tool box which is easy to carry and convenient in use.

2. Description of Prior Art

In order to enhance the convenience in driving screws, the existing screw driver tool is often constituted of a handle portion, a driver rod and a driver head connected to the driver rod. The driver rod is provided with an insertion trough for allowing the driver heads of different dimensions and specifications to be inserted therein. In order to carry these driver heads of different dimensions and specifications, a portable screw driver tool box is proposed. The main body of the screw driver tool box is provided with an accommodating base for allowing the driver heads to be inserted thereon. The accommodating base can be pivotally opened or closed, so that the driver heads on the accommodating base can be hidden or exposed to the outside. A driver rod is fixedly connected to the main body. The driver head is inserted into a distal end of the driver rod for driving screws. By this structure, a screw driver tool box which is easy to carry and store is achieve.

Although the above-mentioned portable screw driver tool box is easy to carry, the length of the driver rod is restricted by the length of the main body, the size of the main body, and the storage of the handle portion. As a result, the handle portion is also restricted to a smaller length, so that the length of arm for applying forces is shorter. Thus, a user has to exert a greater force when driving screws.

SUMMARY OF THE INVENTION

In order to solve the above problems, an objective of the present invention is to provide a screw driver tool box, which is easy to carry and convenient in use.

In order to achieve the above objective, the present invention is to provide a screw driver tool box, which comprises an accommodating box, a plurality of screw heads, and a driver rod. Both sides of the accommodating box are provided with a turnable accommodating base respectively. The accommodating base is provided with a plurality of accommodating troughs for allowing the driver heads to be inserted therein. One end of the driver rod is formed with a handle portion, and the other end thereof is formed into a connecting end. The connecting end is provided with an insertion trough for allowing the driver heads to be inserted therein.

The present invention is characterized in that: the accommodating box comprises a sleeve. One end of the sleeve is formed into an opening for insertion. The walls around the opening are provided with a plurality of grooves and a plurality of clamping claws. The clamping claws protrude from the opening. A through-hole is provided on a wall of the accommodating box to correspond to the opening.

By the above-mentioned structure, a screw driver tool box which is easy to carry and convenient in use is obtained.

DETAILED DESCRIPTION OF THE INVENTION

The technical measures and structural features of the present invention will be described in more detail with reference to preferred embodiment thereof shown in FIGS. 1 to 3.

Figure 1:
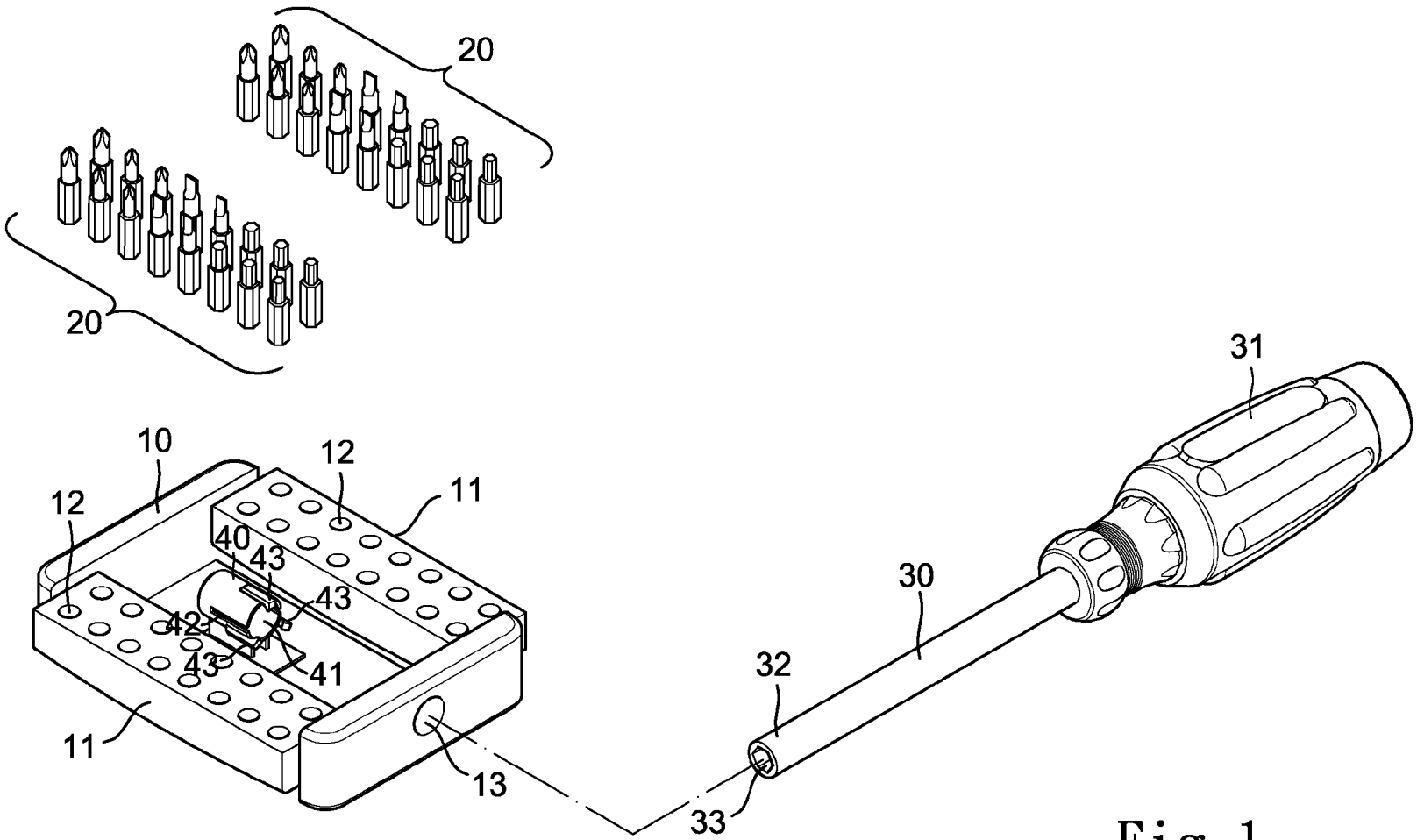
FIG. 1 is an exploded perspective view of the present invention.

As shown in FIG. 1, the screw driver tool box of the present invention comprises an accommodating box 10, a plurality of screw heads 20, and a driver rod 30.

Figure 2:
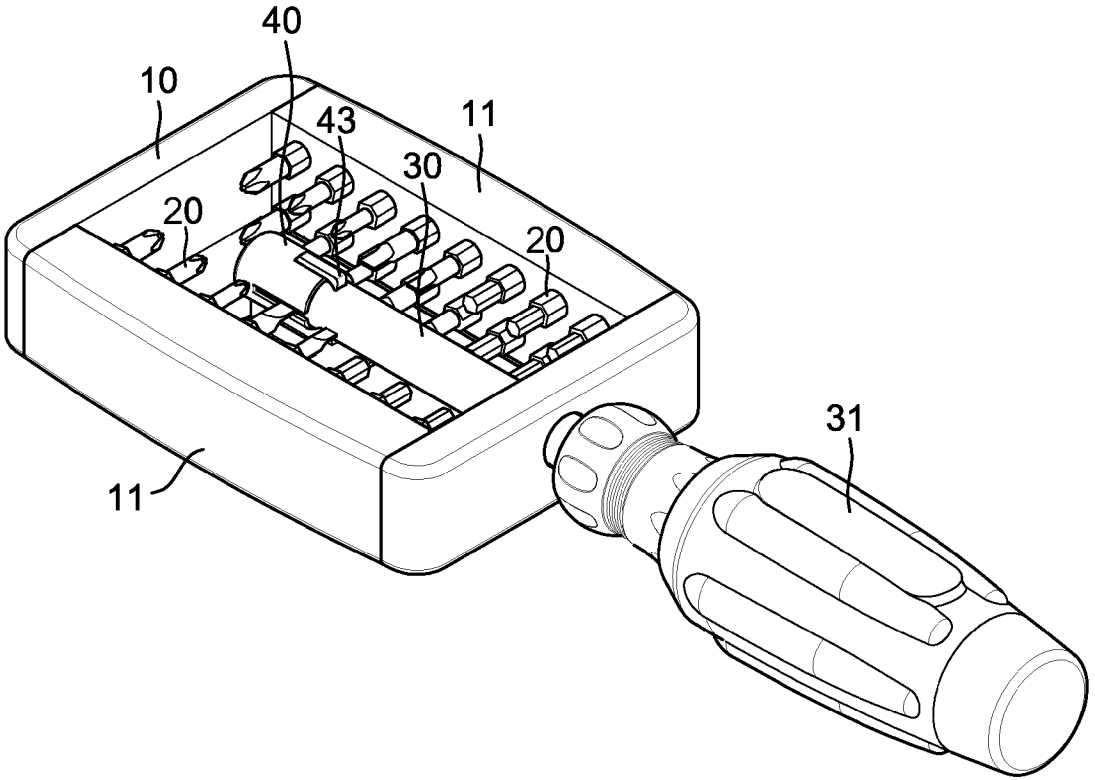
FIG. 2 is an assembled perspective view of the present invention.
Figure 3:
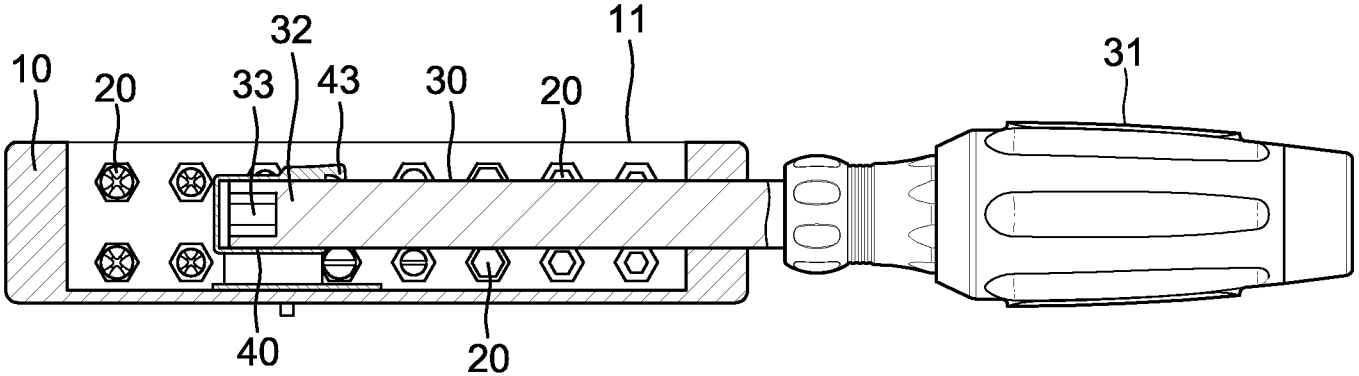
FIG. 3 is a cross-sectional view of the present invention.

Please also refer to FIGS. 2 and 3. Both sides of the accommodating box 10 are provided with a turnable accommodating base 11 respectively. The accommodating base 11 is provided with a plurality of accommodating troughs 12 for allowing the driver heads 20 to be inserted therein.

One end of the driver rod 30 is formed with a handle portion 31, and the other end thereof is formed into a connecting end 32. The connecting end 32 is provided with an insertion trough 33 for allowing one of the screw heads 20 to be inserted therein.

The above structural features of the present invention are substantially equal to those of the conventional screw driver tool boxes, so that the detailed description thereof is omitted for clarify. The structural characteristics of the present invention are as follows.

The accommodating box 10 comprises a sleeve 40. One end of the sleeve 40 is formed with an opening 41 for insertion. The walls around the opening 41 are provided with a plurality of grooves 42 and a plurality of clamping claws 43. The clamping claws 43 protrude above the opening 41. A through-hole 13 is provided on a wall of the accommodating box 10 to correspond to the opening 41.

By the above-mentioned structure, the driver rod 30 is inserted into the accommodating box 10 via the through-hole 13 with the connecting end 32 of the driver rod 30 being inserted into the sleeve 40. The side walls and the clamping claws 43 of the sleeve 40 exert a clamping force onto the connecting end 32 of the driver rod 30, thereby combining the driver rod 30 with the accommodating box 10. Therefore, the screw driver tool box of the present invention is easy to carry and convenient in use. Further, the accommodating box 10 of the present invention allows the driver rod 30 with a larger length to be stored therein, thereby improving the convenience in driving screws.

According to the above, the present invention really improves the problems in the conventional screw driver tool box, so that the present invention really demonstrates inventive steps. Further, the construction of the present invention has not be seen or used in public before filing, so that the present invention also has novelty.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A screw driver tool box, including an accommodating box, a plurality of driver heads and a driver rod, wherein two opposing sides of the accommodating box are rotatably connected to a respective turnable accommodating base, each accommodating base being provided with at least an accommodating trough configured to accept the driver heads for insertion therein, each accommodating base comprising a respective rotatable connection for rotatably connecting to the accommodating box, and one end of the driver rod comprises a handle portion, the other end thereof comprising a connecting end, the connecting end provided with an insertion trough configured to accept the driver heads for insertion therein; and wherein the accommodating box further comprises a sleeve, one end of the sleeve formed with an opening configured for insertion of the connecting end of the driver rod therein, walls around the opening comprising a plurality of grooves and clamping claws, the clamping claws configured to exert a clamping force on the connecting end of the driver rod, and a through-hole is provided on a wall of the accommodating box corresponding to the opening.

* * * * *